US005640809A

United States Patent [19]

Iannelli

[11] Patent Number: 5,640,809

[45] Date of Patent: Jun. 24, 1997

[54] RAIN GUTTER SHIELD

[76] Inventor: Anthony M. Iannelli, 1140 Pamela Dr., Cincinnati, Ohio 45255

[21] Appl. No.: 412,766

[22] Filed: Mar. 29, 1995

[51] Int. Cl.[6] ..... E04O 13/076

[52] U.S. Cl. ..... 52/12; 52/11; 210/474

[58] Field of Search ..... 52/11, 12, 16; 248/48.1, 48.2; 210/162, 163, 469, 473, 474, 477

[56] References Cited

U.S. PATENT DOCUMENTS

| | | | |
|---|---|---|---|
| 546,042 | 9/1895 | Van Horn . | |
| 603,611 | 5/1898 | Nye . | |
| 836,012 | 11/1906 | Cassen . | |
| 870,165 | 11/1907 | Hagler et al. . | |
| 891,405 | 6/1908 | Cassens | 52/12 |
| 1,101,047 | 6/1914 | Yates . | |
| 2,144,663 | 1/1939 | Petersen . | |
| 2,431,012 | 11/1947 | Alig . | |
| 2,569,568 | 10/1951 | Lipshaw . | |
| 2,636,458 | 4/1953 | Harris . | |
| 2,669,950 | 2/1954 | Bartholomew . | |
| 2,672,832 | 3/1954 | Goetz . | |
| 2,847,949 | 8/1958 | Pond | 52/12 |
| 2,873,700 | 2/1959 | Heier . | |
| 2,988,226 | 6/1961 | Campbell . | |
| 3,248,827 | 5/1966 | Hardy . | |
| 3,388,555 | 6/1968 | Foster . | |
| 3,420,378 | 1/1969 | Turner . | |
| 3,507,396 | 4/1970 | Homa . | |
| 3,660,955 | 5/1972 | Simon . | |
| 3,950,951 | 4/1976 | Zukauskas . | |
| 4,198,043 | 4/1980 | Timbes et al. . | |
| 4,254,595 | 3/1981 | Crosslen . | |
| 4,404,775 | 9/1983 | Demartini . | |
| 4,411,110 | 10/1983 | Carey . | |
| 4,435,925 | 3/1984 | Jefferys | 52/12 |
| 4,455,791 | 6/1984 | Elko et al. . | |
| 4,497,146 | 2/1985 | Demartini . | |
| 4,796,390 | 1/1989 | Demartini . | |
| 5,010,696 | 4/1991 | Knittel | 52/12 |
| 5,072,551 | 12/1991 | Manoogian, Jr. | 52/12 |
| 5,181,350 | 1/1993 | Meckstroth | 52/12 |
| 5,375,379 | 12/1994 | Meckstroth | 52/12 |
| 5,457,916 | 10/1995 | Tenute | 52/12 |

FOREIGN PATENT DOCUMENTS

| | | |
|---|---|---|
| 77270 | 11/1979 | Austria . |
| 510773 | 11/1979 | Austria . |

*Primary Examiner*—Michael Safavi
*Attorney, Agent, or Firm*—Frost & Jacobs

[57] ABSTRACT

A rain gutter shield for preventing leaves, other debris and animals from entering a rain gutter of the type attached to a structure adjacent to and directly beneath an edge of a roof of the structure. The rain gutter shield comprises a sheet of material havimg a length and width and being transversely formed to define a substantially planar primary surface securable to the roof such that a portion of the primary surface lies atop the roof. The primary surface is followed by a substantially arcuate surface extending downwardly therefrom and terminating in a trough having a plurality of perforations along its length and being located beneath the substantially arcuate surface of the shield and directed toward the interior of the gutter. The portion of the sheet beyond the trough is formed so as to be securable to the front of the gutter and to provide an upwardly extending deflector positioned beneath the substantially arcuate surface.

16 Claims, 4 Drawing Sheets

RAIN GUTTER SHIELD

BACKGROUND OF THE INVENTION

1. Field of the Invention.

This invention relates to an improved rain gutter shield for preventing leaves and other debris from entering a rain gutter. More specifically, the rain gutter shield of the present invention is formed from a singular sheet of material which has been shaped so as to be easily fit atop a roof adjacent a gutter, and which prevents debris from entering the gutter while at the same time ensuring that rain water will enter the gutter.

2. Description of Related Art.

As any homeowner will attest, leaves and other debris often enter rain gutters, particularly during heavy storms. This accumulation of debris will soon cause the rain gutter to lose its effectiveness, as water will not be able to drain properly. When this occurs, water will not exit the gutter properly, and will overflow in one or more areas. This overflow may cause erosion beneath the gutter, flooding of the basement, and even cracking of the home's foundation. In addition, the water flowing over the gutter adjacent to the home may even cause damage to the building structure itself. Accumulating debris may also begin to rot, thereby causing offensive odors Birds and other animals may also create nests in gutters, particularly if the gutters become plugged. The added weight from the debris and blocked water may also cause the gutter itself to tear away from the house, causing extensive damage.

While many homeowners routinely climb atop the roof of their homes to clean out rain gutters, many devices have been marketed in an attempt to eliminate this dangerous practice. Most of these products comprise a cover which reduces the accumulation of debris within the gutter while still permitting water to enter the gutter. For example, U.S. Pat. Nos. 2,636,458, 2,988,226, and 3,420,378 disclose mesh covers which may be retrofit to a rain gutter. Flat covers such as these, however, often simply permit leaves and other debris to accumulate atop the cover itself. In addition, such devices are often difficult to retrofit to the gutter, requiring various brackets and the like to accomplish the attachment.

Other more elaborate devices have been developed, such as that shown in U.S. Pat. Nos. 4,455,791, and 4,404,755. Gutter deflectors such as these attempt to permit water to be directed into the front area of the gutter while leaves and other debris are ejected over the front edge of the gutter due to the sloping nature of the deflector. Such devices are not always effective during heavy rains, however. In addition, both generally require the use of complicated mounting brackets to ensure proper installation. A sizeable opening is also still present even when these deflectors are installed, and thus birds and other animals are still able to enter the gutters at will. In fact, these devices will not prevent birds from nesting within the rain gutter, which in turn leads to the clogging problems described previously.

Thus, there is a need for an effective, easily-installed rain gutter shield which will prevent debris and animals from entering the gutter, while still directing water into the gutter.

SUMMARY OF THE INVENTION

It is an object of the present invention to provide a rain gutter shield for preventing leaves and other debris from entering a rain gutter.

It is yet another object of the present invention to provide a rain gutter shield which may be readily retrofit to buildings having roofs of varying pitches and gutters of varying structures.

It is still another object of the present invention to provide a rain gutter shield which will also prevent birds and other animals from entering a rain gutter.

The foregoing objects can be accomplished, in accordance with one aspect of the present invention, by providing a rain gutter shield for preventing leaves and other debris from entering a rain gutter, wherein said gutter is attached to a house adjacent to and directly beneath an edge of a roof of said house, the rain gutter shield of the present invention comprising a sheet of material having a length and a width, said sheet formed so as to comprise:

(a) a substantially planar primary surface securable to the roof such that at least a portion of the primary surface may lie atop said roof;

(b) a substantially arcuate surface extending downwardly from the primary surface;

(c) a trough having a plurality of perforations along its length, said perforated trough attached to and positioned beneath said arcuate section; and (d) a front section securable to the front of the gutter;

wherein water may traverse across the primary surface, around at least a portion of the arcuate surface, into the trough, and through the perforations into the trough. The primary surface of the shield preferably has a plurality of protuberances extending across its width.

The front section of the shield preferably has an upwardly-extending deflector positioned beneath the front edge of the arcuate surface, and this deflector preferably has a surface which extends upwardly and angularly away from the trough. The deflector may be triangular, wherein the base of the triangular deflector may be positioned atop the front edge of the gutter. Alternatively, the deflector may be bulbous in shape. The shield is preferably manufactured from a sheet of aluminum. The perforations in the trough preferably comprise a plurality of spaced rectangular openings in the trough, and the primary surface is preferably flexible in nature so that the shield may be effectively employed on a roof of any pitch.

A rain water control structure may also be provided, wherein this rain water control structure comprises (in combination) a roof having a plurality of rows of shingles, a rain gutter positioned beneath the edge of the roof, and the rain gutter shield described above, wherein a portion of the primary surface of the shield is positioned beneath a row of the shingles, and the front section of the shield is secured to the front of the gutter, such that rain water falling upon the roof will traverse across the primary surface, around at least a portion of the arcuate surface, and into the trough, thereafter entering the gutter through the perforations in the trough.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Reference will now be made in detail to the presently preferred embodiments of the invention, examples of which are shown in the accompanying drawings, wherein like numerals indicate the same elements throughout the views.

Figure 2:
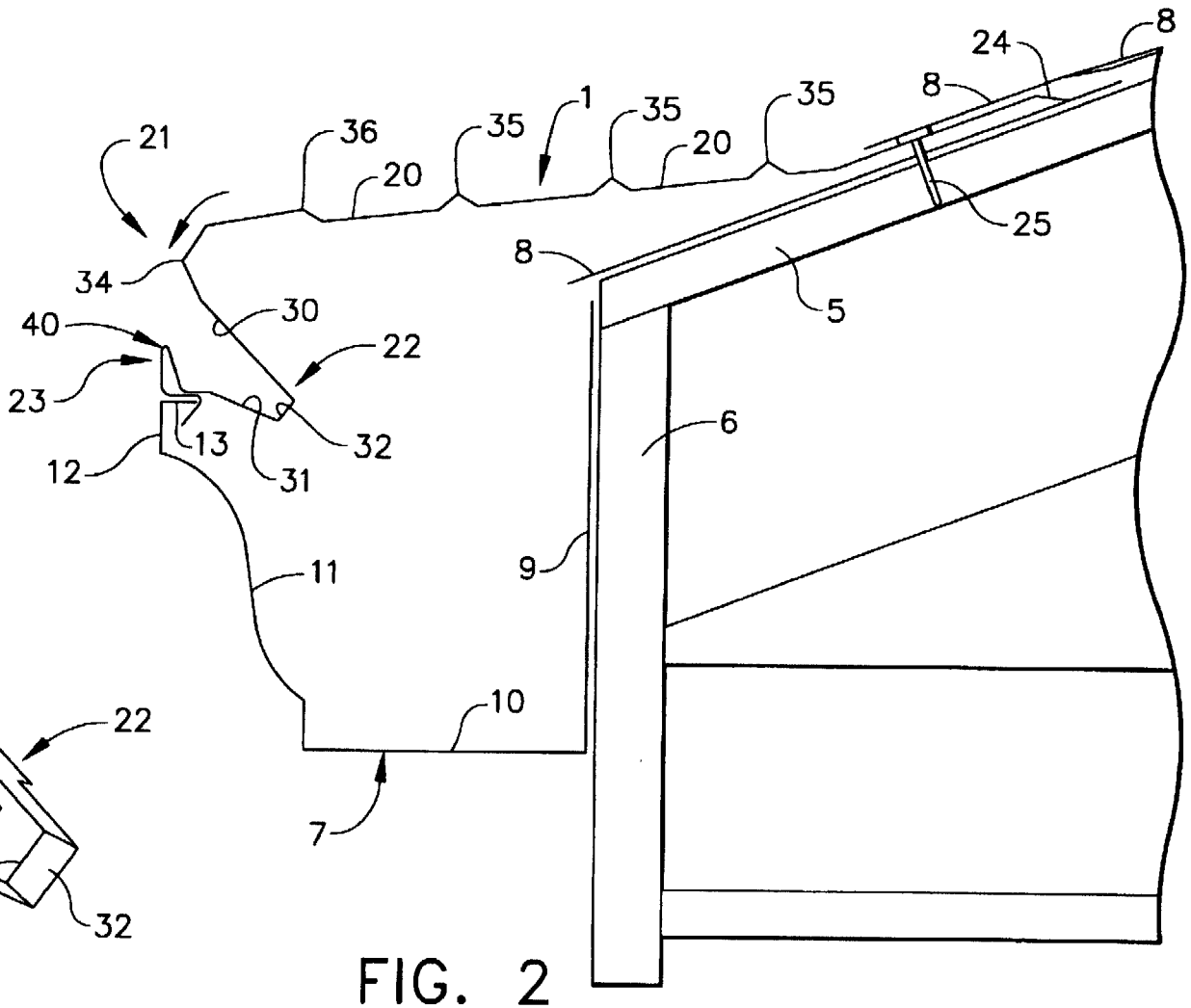
FIG. 2 is a cross-sectional view of the embodiment of FIG. 1 installed on a roof.

FIG. 2 is a cross-sectional view of a typical roof/gutter assembly which can found on homes and other buildings. Sloping roof 5 is positioned atop the building, and a plurality of rows of shingles 8 are secured atop roof 5 in the typical fashion. Fascia 6 extends downwardly from roof 5, and rain gutter 7 is secured to fascia 6. Gutter 7 may be secured in any of a number of fashions, however it is typically secured by means of nails or screws driven directly into fascia 6.

While rain gutter 7 may be of any of a number of styles, most are similar to that shown in FIG. 2. Thus, gutter 7 has a rear wall 9 (which is attached to fascia 6), a bottom wall 10, and a front wall 11. Front wall 11 terminates in a vertical front edge wall 12, and inwardly-extending lip 13. As is well known in the art, water will flow downwardly across shingles 8 and fall into gutter 7. Gutter 7 is sloped slightly towards one or more downspouts which extend downwardly from gutter 7. In this fashion, water will be continuously removed from gutter 7 through these downspouts. Water exiting over the front edge of the shingles, however, will often carry leaves and other debris into gutter 7. These leaves and debris, however, are usually not able to exit the gutter by means of the downspouts. In order to rectify this problem, rain gutter shield 1 of the present invention may be attached to the roof as shown in FIG. 2.

Figure 1:
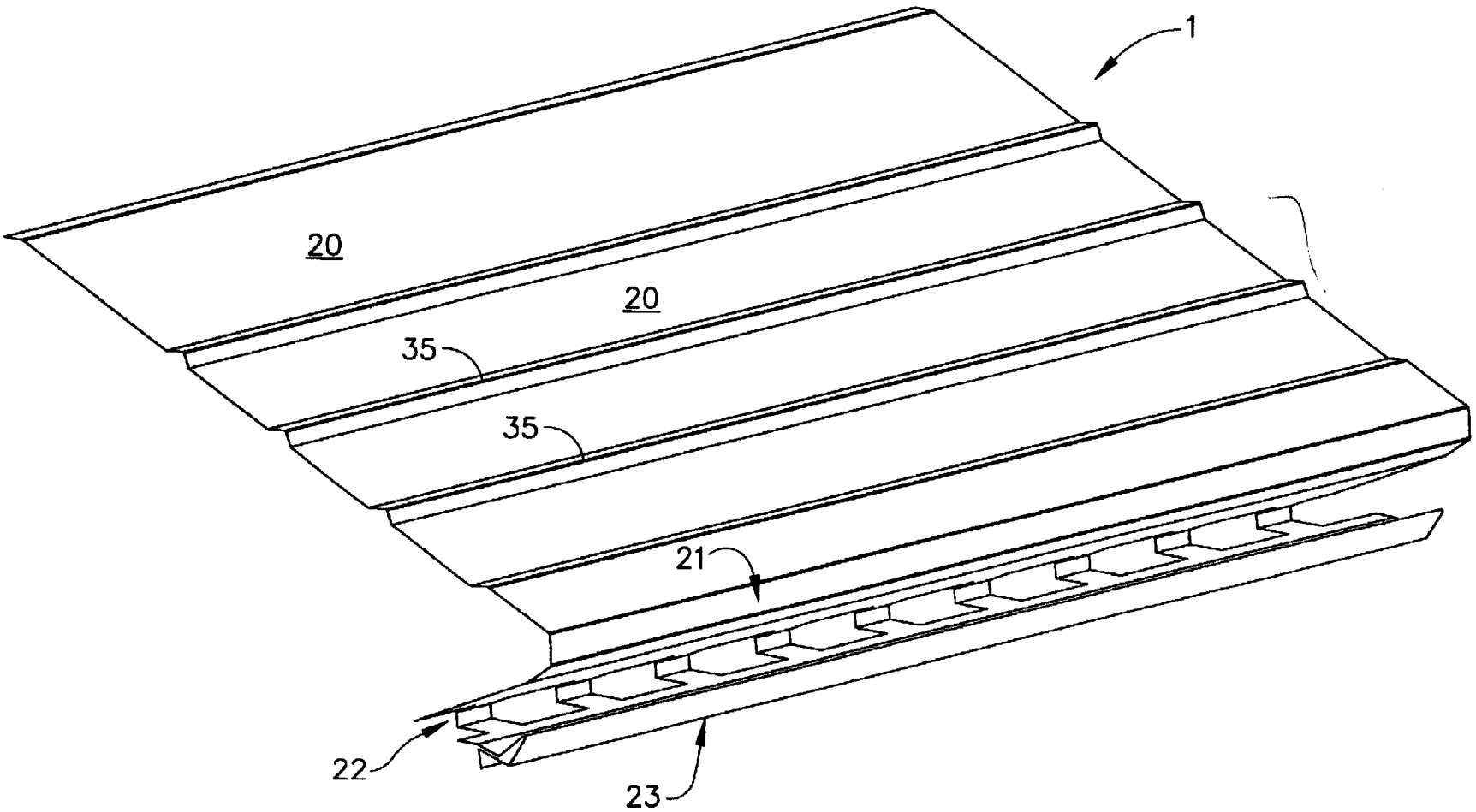
FIG. 1 is a perspective view of a preferred embodiment of the rain gutter shield of the present invention.

FIG. 1 is a perspective view of a preferred embodiment of rain gutter shield 1 of the present invention. As will be apparent, gutter shield 1 is in fact only a portion of the typical length needed, as shield 1 will normally extend across an entire face of a building in order to ensure proper protection of the gutter. Gutter shield 1 may be readily manufactured from a number of materials, including various metals and plastics. When plastic is employed, shield 1 may be molded into the desired configuration. Preferably, however, shield 1 is made from aluminum, and is formed and bent into the desired shape from a rectangular sheet using a roll former. Using this method, shield 1 may be manufactured in any length in order to accommodate varying lengths of gutters. The aluminum sheet used to manufacture shield 1 preferably has a thickness between about 0.022 and about 0.026 inches; most preferably about 0.024 inches. Shield 1 may also be provided in any of a number of colors, since the aluminum may be readily painted using various types of paints. Preferably, a high-quality, baked-on acrylic enamel is employed. These types of paints are often used on aluminum rain gutters, and offer a durable finish.

As best shown in FIG. 2, shield 1 comprises a substantially planar primary surface 20, substantially arcuate nose section 21, perforated trough 22, and front section 23. At least a portion of primary surface 20 is positioned atop roof 5, preferably beneath a row of shingles 8. While it is certainly possible to position primary surface 20 atop all of the shingles, this is not the preferred installation method since some water flowing downward across shingles 8 would flow beneath primary surface 20. Thus, it is preferred that a portion of primary surface 20 be tucked underneath a row of shingles 8 as shown. In most installations, primary surface 20 will be tucked beneath the second row of shingles 8, as shown in FIG. 2. As will be understood more clearly below, depending upon the size of gutter 7 and the size of shingles 8, in some installations primary surface 20 may be tucked beneath a row of shingles further removed from the edge of roof 5. In other words, end 24 of primary surface 20 is positioned beneath a row of shingles 8 so as to ensure that front section 23 is properly positioned at the front edge wall 12 of gutter 7. Once end 24 has been positioned beneath a row of shingles 8 and front section 23 has been secured to gutter 7, it may be secured in place by means of nails 25. Since shield 1 will preferably extend along the length of gutter 7, a plurality of nails 25 are employed along this length. To facilitate proper alignment, a plurality of lines or small grooves, extending parallel to end 24 may also be provided. It should be noted that the spacing between shield 1 and gutter 7, as well as between shield 1 and shingles 8, has been exaggerated slightly for purposes of clarity.

Nose section 21 is preferably substantially arcuate in nature. While this results in the outermost portion of nose 21 being pointed, such an arrangement is generally easier to produce yet produces the same effect as if nose 21 were a smooth convex curve. Thus, "substantially arcuate" is intended to include both a smooth convex curve as well as a pointed nose formed from two or more arcs as shown.

Front section 23 is alignably secured to the front portion of gutter 7, such that front section 23 will be aligned with the front edge of gutter 7. To ensure proper installation, it will normally be necessary to secure front section 23 after end 24 has been tucked underneath a row of shingles 8, but prior to the installation of nails 25. Nails 25 may then be inserted after front section 23 has been properly secured. As shown in FIG. 2, front section 23 is preferably merely clipped to lip 13, thereby alignably securing front section 23 to lip 13. In order to accomplish this, front section 23 has a horizontal leg 26 and clip member 27 (as best shown in FIG. 20*a*). Clip member 27 preferably angles downwardly from horizontal leg 26. The angle between horizontal leg 26 and clip member 27 is preferably less than 90 degrees. In this fashion, horizontal leg 26 will rest atop inwardly extending lip 13. If shield 1 is urged slightly in the direction of the front edge of gutter 7 and then nailed in place, front section 23 will be "locked" into the proper position. In other words, lip 13 will be positioned between horizontal leg 26 and clip member 27 as shown in FIG. 2.

As also shown in FIG. 2, perforated trough 22 extends downwardly away from both arcuate nose section 21 and front section 23 towards the interior of gutter 7. In the preferred embodiment, trough 22 comprises top leg 30, bottom leg 31, and rear wall 32. As will be understood, however, trough 22 can also be curvilinear in nature, or even triangular (such as by the elimination of rear wall 32). The presently preferred embodiment of FIG. 2, however, is generally the easiest to produce from a sheet of material.

Trough 22 is also perforated in nature in order to permit water to pass from trough 22 into gutter 7. Thus, apertures 33 are preferably rectangular in nature, and extend across the entire width of rear wall 32, and partially along the width of both top leg 30 and bottom leg 31. As used herein, the "width" of various portions of shield 1 is that cross-section which extends perpendicular to the length of gutter 7 when shield 1 is properly installed. For simplicity of construction and to ensure effective water removal, a plurality of apertures 33 are preferably evenly spaced along the length of trough 22 (as best shown in FIG. 1). As will be more fully understood below, water will enter trough 22, and thus apertures 33 will ensure the complete passage of the water into gutter 7 along the entire length of shield 1. Of course there are numerous other configurations for apertures 33 which would be effective, as long as the apertures are of sufficient size and number to ensure adequate water passage from trough 22 into gutter 7 (as will described shortly).

As will be understood from FIG. 2, when rain gutter shield has been properly installed with end 24 tucked beneath a row of shingles and front section 23 alignably secured to the front edge of gutter 7, water flowing downwardly across shingles 8 will flow onto primary surface 20. When the water reaches substantially arcuate nose section 21, the water will traverse at least partially around the surface of nose 21 in the direction of the arrow of FIG. 2. Depending upon the flow rate of the water, surface forces will ensure that the water remains in contact with nose 21 as it traverses at least a portion of the surface of nose 21. The outermost portion of nose 21, however is preferably positioned behind the front edge of gutter 7. Thus, water flowing about substantially arcuate nose 21 need only reach outermost point 34 of nose 21. At high flow rates, some water may begin to separate from nose 21 as it flows beyond outermost point 34. Since point 34 is positioned behind the front edge of gutter 7, however, any water separating from the surface of nose section 21 will fall downwardly directly into trough 22 as desired. Once the water enters trough 22, it will pass through the perforations into gutter 7 where it can be removed through the downspouts. Leaves and other debris flowing across primary surface 20 with the water, however, will not remain in contact with the surface of nose section 21, and thus will be ejected beyond the front edge of gutter 7, thereby ensuring that the debris does not enter either trough 22 or gutter 7. In this fashion, rain gutter shield 1 will ensure that gutter 7 remains substantially free of leaves and other debris.

Since the pitch of roof 5 will vary greatly from building to building, it is necessary that shield 1 be adaptable to fit a variety of pitches. On steep roofs, it is also desirable that the slope of primary surface 20 be less than that of roof 5 in order to ensure proper routing of water flowing across the surface of shield 1. Thus, the material used to manufacture shield 1 is such that primary surface 20 will be flexible in nature. This will permit shield 1 to be installed such that primary surface 20 will bow away from roof 5 at the point where primary surface 20 exits from beneath a row of shingles 8 as shown. Since nail 25 is preferably installed near the location where primary surface 20 exits from beneath row of shingles 8, this bowing away from roof 5 can be easily accomplished. Thus, the slope of primary surface 20 will normally be less than that of roof 5 as shown in FIG. 2, thereby reducing the flow rate of water passing across surface 20. Of course the pitch of some roofs may be such that the bowing effect is not necessary in order to ensure proper water flow rates, and thus on these structures surface 20 may be positioned flat against roof 5. The bowing of surface 20 also ensures a minimal amount of deflection of shingles 8 away from roof 5, thereby maintaining the integrity of shingles 8 positioned above surface 20.

In order to further retard the flow rate of water across primary surface 20, one or more protuberances 35 are provided along the length of shield 1. Protuberances 35 act to retard the flow rate of water across primary surface 20, and thus improve the effectiveness of shield 1. These protuberances may be of any cross section, however the triangular cross section shown in FIG. 2 is preferred for simplicity of manufacture. In addition, surface rise 36 is also provided adjacent nose section 21. Surface rise 36 not only reduces the speed of water flowing across primary surface 20, but also enables arcuate nose section 21 to have a larger radius without increasing the overall profile of shield 1. In other words, rise 36 ensures that the radius of substantially arcuate nose section 21 may be sufficient while also permitting the main portion of surface 20 to be positioned closer to roof 5, thereby providing a lower profile for the shield 1.

As mentioned above, depending upon the flow rate, water flowing around arcuate nose section 21 may begin to separate from nose section 21 at or near point 34. When this occurs, the water will fall downwardly under the influence of gravity. In order to ensure that the water separating from nose section 21 will enter perforated trough 22, upwardly-extending deflector 40 is provided on front section 23 of shield 1. Water separating from nose section 21 at or near point 34 will fall downwardly until it strikes deflector 40 and is thereafter be directed into perforated trough 22 as desired. In addition, and perhaps more importantly, deflector 40 ensures that water accumulating in either perforated trough 22 or atop lip 13 will not overflow the front edge of gutter 7. In other words, deflector 40 will act as a weir, thereby ensuring proper routing of the water into gutter 7.

Figure 2A:
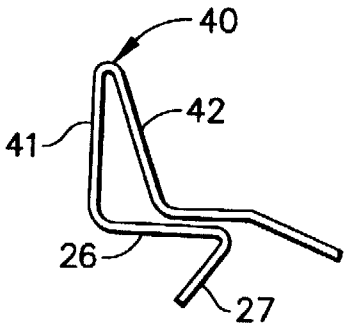
FIG. 2*a* is a cross-sectional view of a portion of the rain gutter shield of FIG. 1.
Figure 2B:
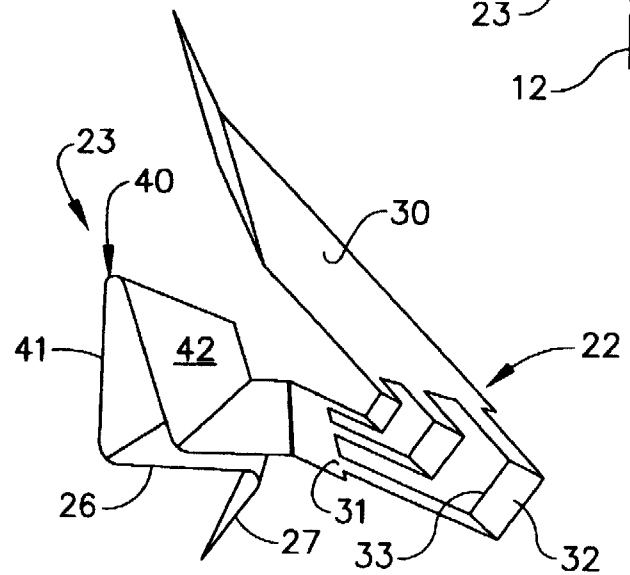
FIG. 2*b* is a perspective view of a portion of the rain gutter shield of FIG. 1.

As shown in FIGS. 2*a*, and 2*b*, deflector 40 preferably is of a triangular cross-section, and more preferably a right triangle. As shown, when deflector 40 is triangular in nature, it has a vertical front wall 41 positioned substantially parallel to front edge wall 12 of gutter 7, and sloping rear wall 42 which angles inwardly towards perforated trough 22. In addition, when deflector 40 is triangular in nature, its base will essentially comprise horizontal leg 26 as shown.

Figure 3:
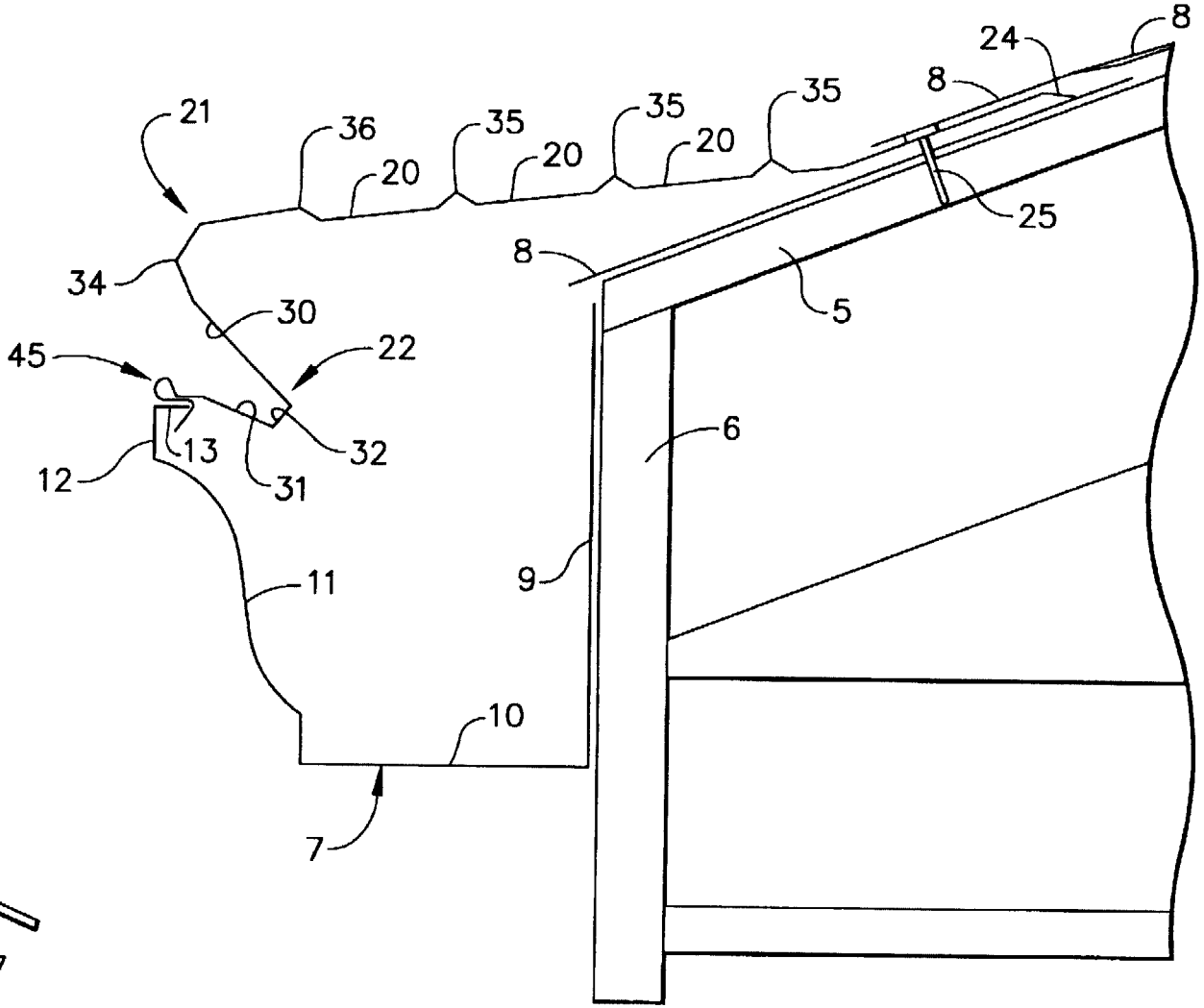
FIG. 3 is a cross-sectional view of an alternative embodiment of the rain gutter shield of the present invention installed on a roof.
Figure 3A:
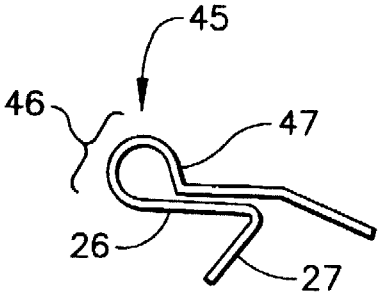
FIG. 3*a* cross-sectional view of a portion of the rain gutter shield of FIG. 3.

As an alternative to the preferred embodiment of FIG. 2, the deflector may also be bulbous in nature as shown in FIGS. 3 and 3*a*. Bulbous deflector 45 has a round front portion 46 extending from horizontal leg 26, and rear surface 47 which extends downwardly at an angle toward perforated trough 22. Thus, rear surface 47 acts in the same fashion as surface 42 previously described in conjunction with triangular deflector 40. Therefore, it will be understood that the only essential feature for the deflector is that it have a surface which extends upwardly away from lip 13 of gutter 7 while also angling away from perforated trough 22. In this fashion, the rear face of the deflector, whether it is of the triangular or bulbous variety, acts to direct the water flow into perforated trough 22 while also ensuring that water will not overflow front edge 12 of gutter 7.

Figure 4:
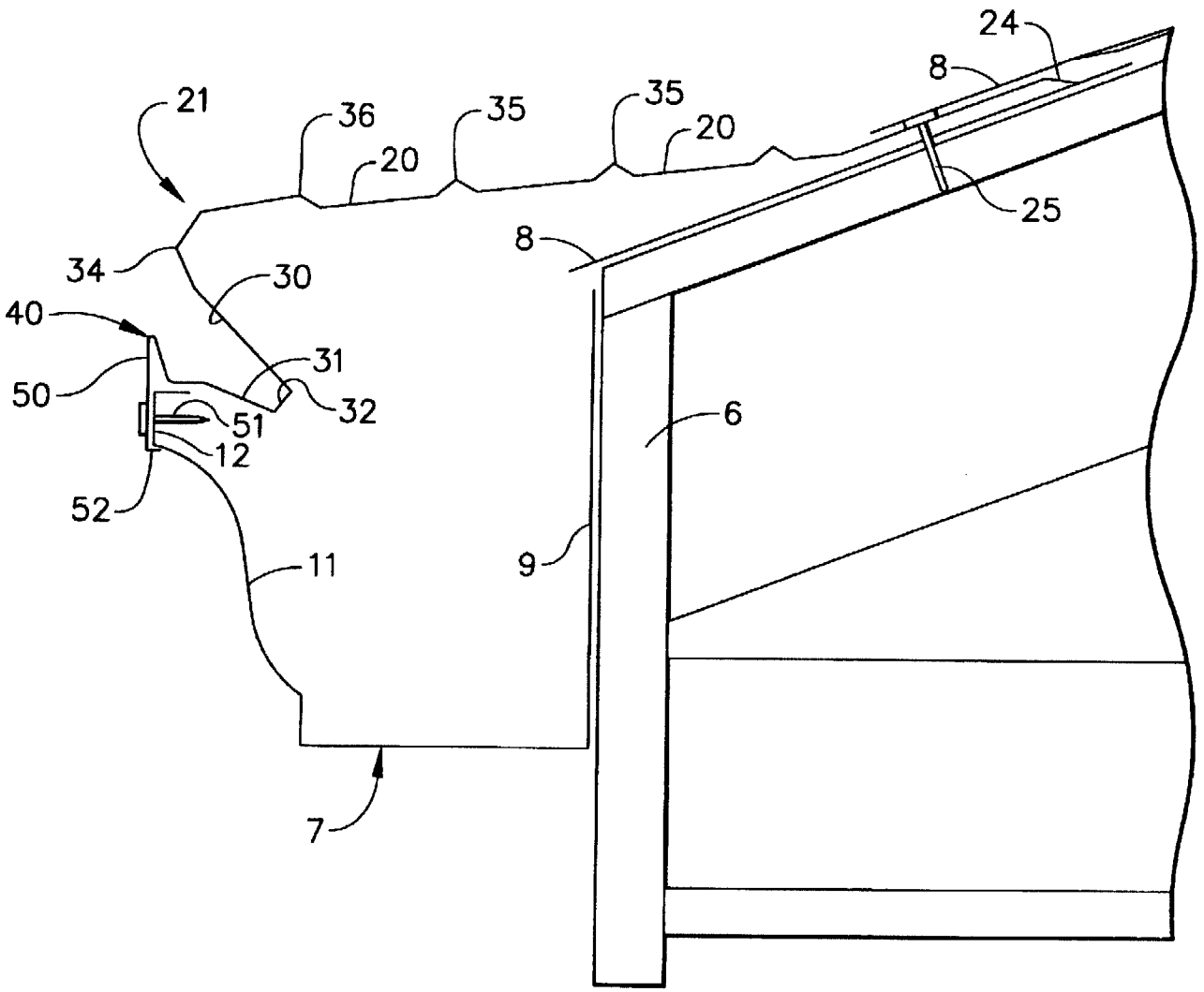
FIG. 4 is a cross-sectional view of another alternative embodiment of the rain gutter shield of the present invention installed on a roof.

As discussed previously, from section 23 of shield 1 is preferably constructed so as to clip to lip 13 of gutter 7. An alternative embodiment for the front section of shield 1, however, is shown in FIG. 4. In some instances, gutter 7 may not be of the shape shown in FIG. 2. In addition, a more secure attachment may also be desired. Thus, the horizontal leg of shield 1 may be replaced with vertical leg 50 as shown in FIG. 4. When a triangular shaped deflector is employed with shield 1, vertical leg 50 will correspond to the vertical front wall of the triangular-shaped deflector (item 41 in FIG. 2*a*) as previously described. Vertical leg 50 may then be secured to front edge 12 of gutter 7 by any of a number of means, including screw 51 as shown. If desired, and if gutter 7 is of a known configuration, horizontal lip 52 may also be provided so that the front section of shield 1 may be readily positioned in the proper location. While the shield shown in FIG. 4 is secured to gutter 7 in a slightly different fashion, the manner in which the shield performs is not changed in any way.

Gutter shield 1 of the present invention offers an effective device for keeping leaves and debris out of gutter 7. Shield 1 can operate over a wide range of water flow rates, and is thus effective even in extremely heavy rain storms. In addition, shield 1 can be attached to nearly any structure having a gutter attached adjacent to the roof, since the flexible nature of primary surface 20 permits proper attachment of shield 1 to almost any roof. Shield 1 also prevents animals such as birds and squirrels from entering gutter 7, since the presence of perforated trough 22 prevents access. In addition, triangular deflector 40, when employed, will also assist in preventing these animals from attempting to nest within perforated trough 22 itself. Thus, rain gutter shield 1 offers many improvements over the prior art.

What I claim is:

1. A rain gutter shield for preventing leaves and other debris from entering a rain gutter attached to a house adjacent to and directly beneath an edge of a roof of the house, said shield comprising a sheet of material having a length and a width, said sheet formed so as to comprise:

(a) a substantially planar primary surface securable to said roof such that at least a portion of said primary sheet may lie atop said roof;

(b) a substantially arcuate surface extending downwardly from said primary surface;

(c) a trough positioned beneath said arcuate section, said trough comprising a rear wall extending downwardly from said arcuate surface, a bottom having a plurality of perforations alone its length, and a forward upwardly directed wall; and (d) a from section extending from said trough front wall and being securable to the front of said gutter, said from section having an upwardly extending deflector positioned above and forwardly of said trough front wall and below said arcuate surface;

wherein water may traverse across said primary surface, around at least a portion of said arcuate surface, into said trough, and through said trough perforations into said gutter.

2. The shield of claim 1, wherein said primary surface has a plurality of water flow retarding protuberances extending across its width.

3. The shield of claim 1, wherein said deflector has a surface which extends upwardly and angularly away from said trough.

4. The shield of claim 3, wherein said deflector is triangular, and wherein the base of said triangular deflector may be positioned atop the front edge of said gutter.

5. The shield of claim 3, wherein said deflector is bulbous in shape.

6. The shield of claim 3, wherein said material is aluminum.

7. The shield of claim 3, wherein said perforations comprise a plurality of spaced rectangular openings in said trough.

8. The shield of claim 7, wherein said primary surface is flexible in nature so that said shield may be effectively employed on a roof of any pitch.

9. A rain water control structure, comprising in combination a roof having a plurality of rows of shingles, a rain gutter positioned beneath the edge of said roof, and a rain gutter shield, said rain gutter shield comprising a sheet of material having a length and a width, said sheet formed so as to comprise:

(a) a substantially planar primary surface;

(b) a substantially arcuate surface extending downwardly from said primary surface;

(c) a trough positioned beneath said arcuate section and being directed toward the interior of said gutter said trough comprising a rear wall extending downwardly from said arcuate surface, a bottom having a plurality of perforations along its length, and a forward upwardly directed wall; and (d) a front section extending from said trough front wall and being securable to the front of said gutter, said front section of said shield having an upwardly extending deflector positioned above and forwardly of said trough front wall and beneath the front edge of said arcuatc surface;

wherein a portion of said primary surface of said shield is positioned beneath a row of said shingles, and said front section of said shield is secured to the front of said gutter, such that rain water falling upon said roof will traverse across said primary surface, around at least a portion of said arcuate surface, and into said trough, thereafter entering said gutter through said perforations in said trough, water filling downwardly from said arcuate surface being directed by said deflector into said trough.

10. The rain water control structure of claim 9, wherein said primary surface of said shield has a plurality of water flow retarding protuberances extending across its width.

11. The rain water control structure of claim 9, wherein said deflector has a surface which extends upwardly and angularly away from said trough.

12. The rain water control structure of claim 11, wherein said deflector is triangular, and wherein the base of said triangular deflector is positioned atop the front edge of said gutter.

13. The rain water control structure of claim 11, wherein said deflector is bulbous in shape.

14. The rain water control structure of claim 11, wherein said material is aluminum.

15. The rain water control structure of claim 11, wherein said perforations comprise a plurality of spaced rectangular openings in said trough.

16. The rain water control structure of claim 9, wherein said primary surface is flexible in nature so that the pitch of said shield is less than the pitch of said roof.

* * * * *

UNITED STATES PATENT AND TRADEMARK OFFICE

CERTIFICATE OF CORRECTION

PATENT NO. : 5,640,809

DATED : June 24, 1997

INVENTOR(S) : Anthony M. Iannelli

It is certified that error appears in the above-indentified patent and that said Letters Patent is hereby corrected as shown below:

On the title page, in the second column, at the end of the "References Cited" section, please add OTHER REFERENCES and list thereunder --Waterloov/ Product Brochure, 1994-- and --Perma Flow Advertisement, September 1994--.

Column 7, line 29 (claim 1), the word "alone" should read as --along--.

Column 7, line 32 (claim 1), the word "from" should read as --front--.

Column 8, line 14 (claim 9), "gutter said" should read as --gutter, said--.

Column 8, line 31 (claim 9), the word "filling" should read as --falling--.

Signed and Sealed this

Second Day of September, 1997

*Attest:*

*Attesting Officer*

BRUCE LEHMAN

*Commissioner of Patents and Trademarks*